US006582868B2

(12) United States Patent
Urabe

(10) Patent No.: US 6,582,868 B2
(45) Date of Patent: Jun. 24, 2003

(54) IMAGE FORMING APPARATUS AND DEVELOPING AGENT

(75) Inventor: Takashi Urabe, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/984,787

(22) Filed: Oct. 31, 2001

(65) Prior Publication Data

US 2003/0099891 A1 May 29, 2003

(51) Int. Cl.[7] ..... G03G 9/097

(52) U.S. Cl. ..... 430/108.6; 399/47; 399/61

(58) Field of Search ..... 399/61, 49; 430/108.21

(56) References Cited

U.S. PATENT DOCUMENTS

| | | | | |
|---|---|---|---|---|
| 5,974,279 A | * | 10/1999 | Slabbaert et al. | 399/61 |
| 6,326,113 B1 | * | 12/2001 | Okuda et al. | 430/108.21 |
| 6,342,327 B1 | * | 1/2002 | Urabe | 430/108.21 |

FOREIGN PATENT DOCUMENTS

| | | |
|---|---|---|
| JP | 2000-19905 | 1/2000 |
| JP | 2001-051442 | 2/2001 |

* cited by examiner

*Primary Examiner*—John Goodrow
(74) *Attorney, Agent, or Firm*—Foley & Lardner

(57) ABSTRACT

A developing agent comprising a photocatalytic component is employed, wherein the developing agent is irradiated with predetermined light to decompose water molecule, thereby making it possible to prevent the electric charge of developing agent from being dissipated, which may be otherwise caused to occur due to the water that has been adsorbed onto the developing agent.

16 Claims, 2 Drawing Sheets

IMAGE FORMING APPARATUS AND DEVELOPING AGENT

BACKGROUND OF THE INVENTION

Since it is necessary to precisely control the quantity of developing toner in order to obtain an excellent image, it is indispensable to sufficiently stabilize a charge amount of toner relative to changes in ambient conditions and to the lapse of time. Therefore, a charge controlling agent CCA is generally incorporated into a developing agent together with a binder resin and a coloring agent.

For example, a low molecular weight substance having a structure of a quaternary ammonium salt, organophosphorus or phosphate compound is employed for a positively electrifiable toner, whereas a low molecular weight substance having a structure of metal salt of salicylic acid or a structure of tetraphenyl borate is employed for a negatively electrifiable toner. Alternatively, it is also possible to improve the charging characteristics of a developing agent by providing a binder resin to be employed with a charge controlling capability. For this purpose, there has been practiced the introduction of a polar group into a binder resin or to incorporate a resin having a polar group into a developing agent.

In the introduction of a polar group into a binder resin, the method that has been conventionally practiced is to modify the binder resin with guanamine or a guanamine derivative by taking advantage of the terminal OH group of polyester; to allow the primary amine of epoxy resin to react with dihydric phenols; to allow the epoxy group of epoxy resin to react with alcohols, etc.; to seal the terminal OH group and acid group of polyester using a masking agent; or to allow the epoxy group of epoxy resin to react with a monovalent active hydrogen-containing compound.

In the incorporation of a resin having a polar group to a binder resin, the resins that have been employed as a resin having a polar group are a copolymer of an amino group-containing compound, a polysilane compound, a copolymer of styrene with a quaternary ammonium salt, etc.

Further, it is known that the charge amount of a developing agent is influenced by the ambient atmosphere, i.e. the charge amount of a developing agent increases under the conditions of low temperature and low humidity, but decreases under the conditions of high temperature and high humidity. Namely, under the conditions of high temperature and high humidity, water molecules are assumed to adsorb onto the toner, which dissipates the electric charge from the toner. Accordingly, there have been taken various countermeasures such as the incorporation of a charge controlling agent as mentioned above, and the surface treatment of toner using a substance exhibiting hydrophobicity. However, it is still impossible, with these conventional countermeasures, to sufficiently control the charge amount of a developing agent, thus raising a problem that an image exhibiting prominent blushing would be produced under the conditions of high temperature and high humidity.

BRIEF SUMMARY OF THE INVENTION

This invention has been accomplished in view of the aforementioned circumstances, and therefore, an object of this invention is to provide an image forming apparatus which is capable of suppressing fluctuations in the charge amount due to changes in ambient conditions and to the lapse of time, and therefore capable of stably obtaining an image of excellent quality.

According to a first aspect of this invention, there is provided an image forming apparatus comprising;

an image carrier;

a developing device for visualizing an electrostatic latent image formed on the image carrier by a developing agent to form a developing agent image, the developing device being disposed to face the image carrier and provided with a member containing a photocatalytic component which is capable of photo-decomposing water molecules to thereby produce active oxygen, and with a light-irradiating mechanism for irradiating light with a wavelength for activating the photocatalytic component;

a transferring device for transferring the developing agent image onto a recording material; and a fixing device for fixing the transferred developing agent image onto the recording material.

According to a second aspect of this invention, there is provided a developing agent comprising a binder resin, a coloring agent, and a photocatalytic component which is capable of photo-decomposing water molecules to thereby produce active oxygen.

The developing agent according to this invention is suited for use in the image forming apparatus of this invention.

According to the present invention, it is now possible to decompose water molecules in the atmosphere inside the developing device, in particular, water components, etc., which are adsorbed onto the developing agent by the photocatalytic effect. As a result, it is now possible to prevent the dissipation of electric charge of a developing agent resulting from the water that has been adsorbed onto the developing agent. As explained above, it is possible, through the employment of this invention, to suppress fluctuations in charge amount due to changes in ambient conditions and to the lapse of time, thereby making it possible to stably obtain an image of excellent quality.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

Figure 1:
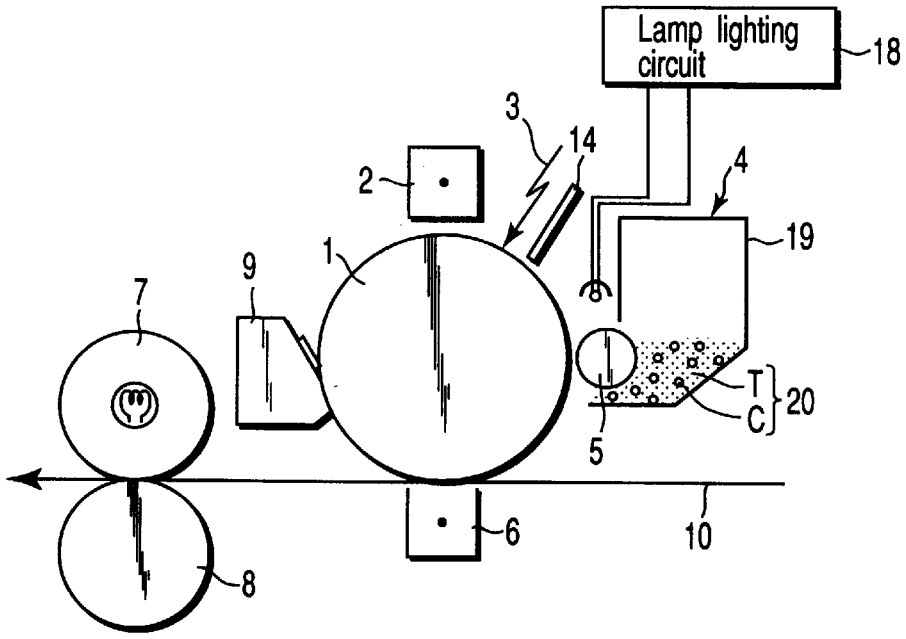
FIG. 1 is a schematic view illustrating a first embodiment of image-forming apparatus according to this invention.

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

The image-forming apparatus according to a first aspect of this invention comprises an image carrier; a developing device disposed to face the image carrier, for visualizing an electrostatic latent image formed on the image carrier by a developing agent to form a developing agent image; a transferring device for transferring the developing agent image onto a recording material; and a fixing device for fixing the transferred developing agent image onto the recording material;

in which the developing device is provided therein with a member containing a photocatalytic component which is capable of photo-decomposing water molecules to thereby produce active oxygen, and with a light-irradiating mechanism for irradiating light with a wavelength for activating said photocatalytic component.

The developing agent according to a second aspect of this invention is suited for use in the aforementioned image forming apparatus and comprises a binder resin, a coloring agent, and a photocatalytic component which is capable of photo-decomposing water molecules to thereby produce active oxygen.

According to this invention, at least one of the members disposed inside the developing device to be employed, such as the developing agent, the inner wall, etc. is formed so as to contain a photocatalytic component which is capable of photo-decomposing water molecules to thereby produce active oxygen. According to this invention, by making use of the light-irradiating mechanism, light with a wavelength capable of activating the photocatalytic component is irradiated onto the aforementioned member to thereby decompose water molecules in the atmosphere inside the developing device, in particular, the water components, etc., that have been adsorbed onto the developing agent by the photocatalytic effect, thus generating active oxygen. When water components are decomposed in this manner, the dissipation of the electric charge of developing agent can be prevented, even under the conditions of the high temperature and high humidity which may occur over a period of time for example, thus making it possible to obtain an image which is almost free from blushing.

As for a photocatalytic component which can be employed in this invention and is capable of photo-decomposing water molecules to thereby produce active oxygen, it is possible to employ, for example, metal oxide semiconductors, etc. These metallic semiconductor compounds are capable of exhibiting a photocatalytic effect upon the absorption of light of a certain energy band gap. Specific examples of metal oxide semiconductor useful in this invention include $Fe_2O_3$(2.2), $Cu_2O$(2.2), $In_2O_3$(2.5), $WO_3$(2.7), $Fe_2TiO_3$(2.8), PbO(2.8), $V_2O_5$(2.8), $FeTiO_3$(2.8), $Bi_2O_3$ (2.8), $Nb_2O_3$(3.0), rutile-type $TiO_2$(3.0), anatase-type $TiO_2$ (3.2), $SrTiO_3$(3.2), ZnO(3.3), $BaTiO_3$(3.3), $CaTiO_3$(3.4), $KTaO_3$(3.5), $SnO_2$(3.6) and $ZrO_2$(5.0).

Energy band gaps are given in paretheses after compositions of oxides, respectively.

In this invention, these metal oxide semiconductors can be employed singly or in a combination of two or more kinds thereof.

Among these metal oxide semiconductors, especially preferable examples are $Fe_2O_3$, $Cu_2O$, $In_2O_3$, $WO_3$, $Fe_2TiO_3$, PbO, $V_2O_5$, $FeTiO_3$, $Bi_2O_3$, $Nb_2O_3$, $TiO_2$, and $SrTiO_3$.

These semiconductor oxides should preferably have primary particles whose diameter is 30 nm or less.

Titanium oxide can be used preferablely.

More preferably, the anatase-type titanium oxide can be used as titanium oxide.

As for the members containing any of the aforementioned photocatalytic components, it is possible to employ, for example, a developing agent, the inner wall of a developing device, the inner wall of a toner cartridge, etc.

When it is desired to incorporate these photocatalytic components into a developing agent, it is possible to employ a method wherein particles of photocatalytic component are mixed with the developing agent, or a method wherein any of the aforementioned photocatalytic components is coated on the surface of the toner particles of the developing agent.

As for the coating method to be employed in this case, it is possible to employ a method wherein any of the aforementioned photocatalytic components is mechanically or mechanochemically adhered onto the surface of the toner particles. As for the apparatus or system to be employed in this coating method, it is possible to employ a Henschel mixer (Mitsui Mining Co., Ltd.), mechanofusion (Hosokawa Micron Co., Ltd.), hybridization (Nara Machine Co., Ltd.), and a surfusion system (NPK Co., Ltd.).

The photocatalytic component can be added to toner particles preferably at a ratio of 0.1% by weight or more, more preferably at a ratio ranging from 0.01 to 10% by weight. If the photocatalytic component is to be coated on the surface of toner particles, it is preferable, for ensuring a sufficient covering, to apply 0.7% by weight or more to the surface of toner particles.

When it is desired to apply these photocatalytic components onto the inner wall of a developing device, a photocatalytic layer may be formed on an inner wall which is disposed at a predetermined angle relative to the inner wall provided with an ultraviolet light-irradiating window for instance. The ultraviolet light is designed to be refracted by this ultraviolet light irradiating window, thereby easily enabling the ultraviolet light to be irradiated onto the photocatalytic layer. The photocatalytic layer can be formed by various methods, including a method of coating a photocatalytic component which has been dissolved or dispersed in a solvent, a sputtering method, a plasma polymerization method, or a CVD method.

As for the light-irradiating mechanism, it is possible to employ a black-light, a mercury lamp, xenon lamp, etc.

A window formed of a light-transmitting member may be provided at a portion of the envelope of the developing device for instance. Alternatively, a light-transmitting member may be provided all over the envelope.

The light-irradiating mechanism may be disposed either inside or outside the developing device. For example, the light-irradiating mechanism can be disposed over the developing roller which is placed to face the photoreceptor, or at a position facing the aforementioned window. A lens for converging light as well as a mirror for reflecting light may be interposed between the developing roller and the aforementioned window.

Preferably, the image forming apparatus of this invention may be further provided with a mechanism which is connected with the light-irradiating mechanism so as to enable the magnitude of irradiation of light to be changed in conformity with humidity.

Next, this invention will be further explained in detail with reference to the accompanying drawings.

FIG. 1 shows a schematic view illustrating a first embodiment of the image forming apparatus.

As shown in FIG. 1, a surface potential of such as −500 to 800V may be uniformly applied to a rotatable photosensitive drum 1 by an electrification device 2. Then, an electrostatic latent image can be formed on the surface of the photoreceptor 1 by an exposure light from an exposure device (not shown). Then, by making use of a developing agent 20 of this invention that has been electrified by a developing device 4, the electrostatic latent image is visualized.

A light-irradiating mechanism which is capable of emitting light of a predetermined wavelength, such as a mercury lamp 11 may be disposed at any suitable place outside the developing device 4, for instance, at a place over a developing roller 5 which is disposed to face the photoreceptor. This mercury lamp 11 is connected with a lamp lighting circuit 18. By way of this mercury lamp 11, the developing agent can be directly irradiated with light of a predetermined wavelength, such as ultraviolet light. The developing agent 20 employed on this occasion contains a toner T comprising a carrier C, a coloring agent, a toner containing a binder resin, and a photocatalytic component which is capable of photo-decomposing water molecules to thereby produce active oxygen. The lamp lighting circuit 18 is designed to control the voltage to be applied to the lamp 11, which is designed to emit light of a predetermined wavelength and luminous energy corresponding to the voltage that has been applied thereto to the developing agent which is being carried on the surface of the developing roller 5. In this developing agent that has been irradiated with this light of a predetermined wavelength, the water molecules that has been adsorbed onto the surface of developing agent are caused to decompose due to the photocatalytic effects of the photocatalytic component.

At a place located on the upstream side of the developing device 4 and kept sufficiently away from the exposure light emitted from the exposure device, a member 14 for shielding the ultraviolet light from the exposure light is positioned.

On the downstream side of the developing device 4, a transfer roller 6 is pressed onto the photoreceptor 1, and a paper P as a transferring body is interposed between the transfer roller 6 and the photoreceptor 1. By applying a bias voltage of +300 to 5 kV onto the belt 5 by means of a high-voltage source (not shown), the toner image formed on the photoreceptor 1 is transferred onto the paper P. Coincident with the application of the transferring bias onto the transfer device 6, the paper P as a transferring body is transferred to the transcription nip region. The paper that has passed through this transcription nip region between the photoreceptor 1 and the feeding roller 8 is then allowed to move to the fixing device 11.

At the fixing unit 11, the fixing of the toner is performed by means of a heat roller 7 and a press roller 8 at a fixing temperature of 160 to 190° C.

Figure 2:
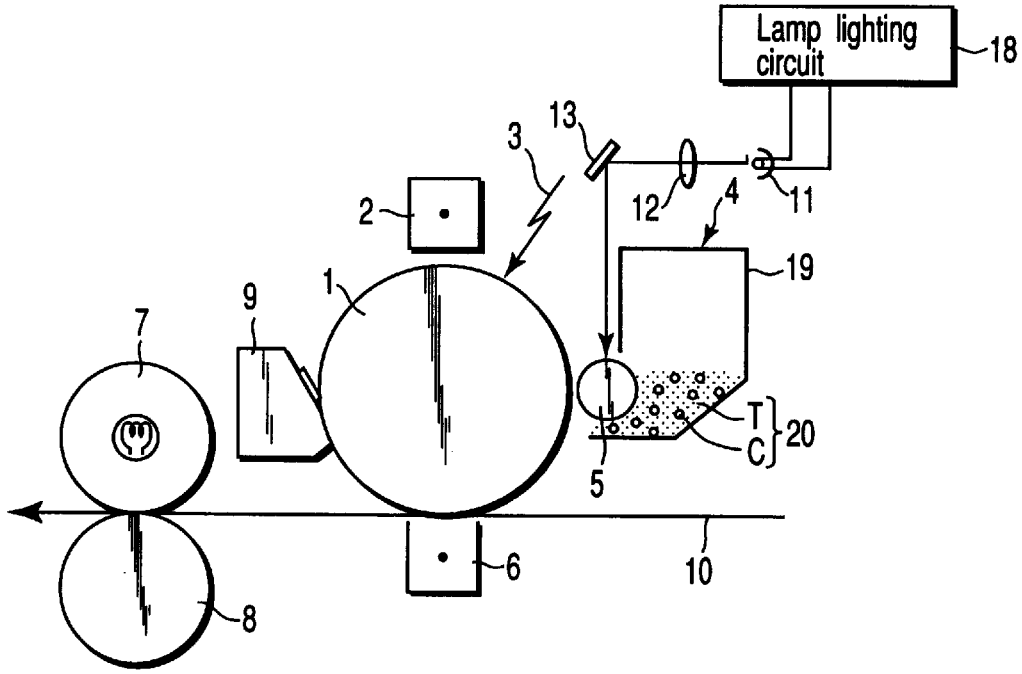
FIG. 2 is a schematic view illustrating a second embodiment of image-forming apparatus according to this invention.

FIG. 2 shows a second embodiment of the image forming apparatus shown in FIG. 1.

This image forming apparatus is constructed in almost the same manner as the apparatus shown in FIG. 1 except that a lens 21 is interposed between the mercury lamp 11 and the developing roller 5 so as to converge the light from the mercury lamp 11, the light thus converged being permitted to be reflected by the mirror 1 so as to irradiate the developing agent from over the developing roller.

Figure 3:
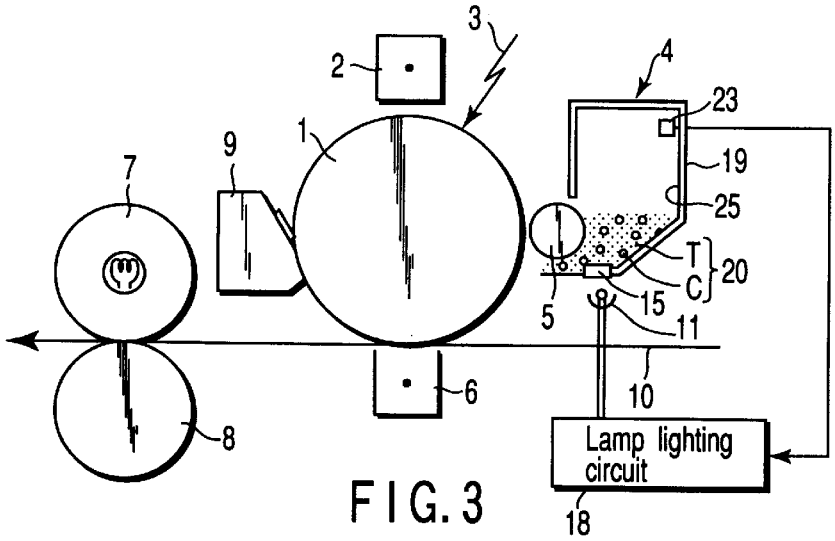
FIG. 3 is a schematic view illustrating a third embodiment of image-forming apparatus according to this invention.

FIG. 3 shows a third embodiment of the image forming apparatus of this invention.

This image forming apparatus is constructed in almost the same manner as the apparatus shown in FIG. 1 except that a window 15 constituted by a light-transmitting member is provided on a lower wall of the envelope 19 of the developing device 4, the mercury lamp 11 is disposed outside the envelope 19 so as to face the window 15, a humidity sensor 23 is disposed inside the developing device, and an active oxygen-adsorbing member 25 which is constituted by an adsorption layer formed of activated carbon is attached to a portion of the inner wall of the envelope 19. The humidity sensor 23 may be optionally employed in the image forming device of this invention. As the is humidity inside the developing device is detected by this humidity sensor 23, the signal of the detected humidity is transmitted to the lamp lighting circuit 18 which is designed to control the voltage to be applied to the lamp 11, according to the signal from the humidity sensor 23. This lamp 11 is designed to emit light of a predetermined wavelength and luminous energy corresponding to the voltage that has been applied thereto to the developing agent which is being carried on the surface of the developing roller 5.

Figure 4:
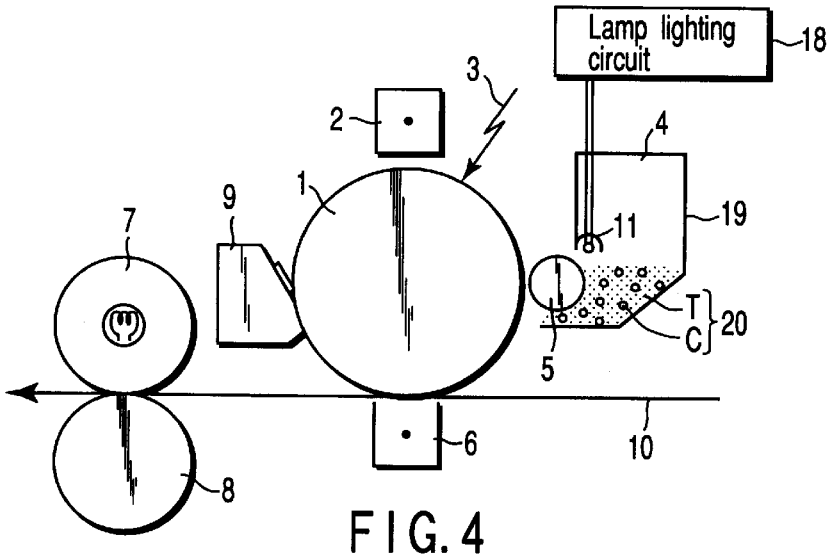
FIG. 4 is a schematic view illustrating a fourth embodiment of image-forming apparatus according to this invention.

FIG. 4 shows a fourth embodiment of the image forming apparatus of this invention.

This image forming apparatus is constructed in almost the same manner as the apparatus shown in FIG. 1 except that the mercury lamp 11 is disposed inside the envelope 19 of the developing device 4.

Figure 5:
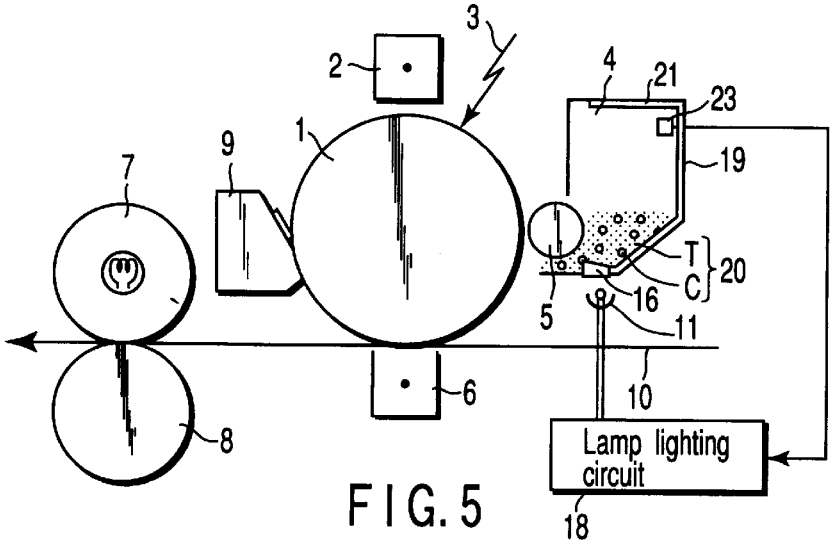
FIG. 5 is a schematic view illustrating a fifth embodiment of image-forming apparatus according to this invention.

FIG. 5 shows a fifth embodiment of the image forming apparatus of this invention.

This image forming apparatus is constructed in almost the same manner as the apparatus shown in FIG. 3 except that a layer 21 containing a photocatalytic component which is capable of photo-decomposing water molecules to thereby produce active oxygen is provided at a portion of the inner wall of the envelope 19 of the developing device 4, and a window 16 constituted by a light-transmitting member capable of refracting incident light toward the layer 21 containing a photocatalytic component is provided in place of the window 15. According to this apparatus, the positive hole generated by the irradiation of light onto the layer 21 containing a photocatalytic component is allowed to effectively react with water so as to decompose the water molecules. Further, in this apparatus, it is possible to produce active oxygen by employing a developing agent which does not contain the photocatalytic component capable of photo-decomposing water molecules.

In the foregoing description, some embodiments of the image forming apparatus according to this invention have been explained. However, it should not be construed that this invention is limited to these embodiments.

Next, specific examples of the developing agent which are applicable to the aforementioned apparatus will be explained.

EXAMPLE 1

A developing material having the following composition was prepared.

| | | |
|---|---|---|
| Binder resin: | Styrene/acrylic copolymer | 90 weight parts |
| Pigment: | Carbon black | 5 weight parts |
| Wax: | Propylene wax | 4 weight parts |
| CCA: | Color metal complex | 1 weight part |

This developing material was dispersed using a gas stream atomizer, after which the developing material was kneaded using a biaxial extruder and extruded into a sheet.

This sheet-like kneaded material thus obtained was coarsely crushed by means of a mechanical mill into particles having a diameter of about 1 mm. This coarsely crushed matter was further finely pulverized by means of an ultra-sonic jet pulverizer and classified by means of an air classifier to obtain a powdery toner having an average volume diameter of about 10 $\mu$m.

Then, 0.5 parts of silica and 0.1 parts of rutile type titanium oxide were allowed to adhere onto the surface of this powdery toner by making use of an air mixer to obtain a desired toner.

The toner thus obtained was mixed with ferrite carrier having an average particle diameter of 65 μm and coated with silicone resin, such as EF95-60A, EF963-60B or EF96-40B (all available from Powder Tech Co., Ltd.), thereby obtaining a developing agent.

A portion of the developing agent thus obtained was left to stand for 8 hours under the conditions of low temperature, i.e. 10° C. and low humidity, i.e. 20%; or under the conditions of high temperature, i.e. 30° C. and high humidity, i.e. 85%. Subsequently, each sample of the developing agent was subjected to aging by applying each sample to an image forming apparatus (PREMAGE 455, Toshiba Tech Co., Ltd.). The irradiation of ultraviolet light was not applied on the occasion of aging the developing agent which was left to stand under the conditions of low temperature and low humidity, but was applied only on the occasion of aging the developing agent which was left to stand under the conditions of high temperature and high humidity. The irradiation of ultraviolet ray was performed through the ultraviolet-transmitting window which was provided at a portion of the developing device filled with a developing agent.

Subsequently, the charge amount of each of the developing agents was measured by making use of a suction type blow-off electrification-measuring device (TB-220, Toshiba Chemical Corporation). As a result, the charge amount was found to be 32.4 of q/m under the conditions of low temperature and low humidity, and 21.9 of q/m under the conditions of high temperature and high humidity. Therefore, the coefficient of fluctuation of ambient conditions represented by "electrification under the low temperature and low humidity conditions/electrification under the high temperature and high humidity conditions" was found to be 1.48, thus making it possible to obtain an excellent image which is relatively low in blushing even under the conditions of high temperature and high humidity. The blushing was determined by measuring the ΔE value by making use of a spectral calorimeter (X-rite Co., Ltd.). The results obtained in this example are shown in the following Table 1.

COMPARATIVE EXAMPLE 1

The same procedures as described in Example 1 were repeated except that the irradiation of ultraviolet light was not performed in the process of aging under the conditions of high temperature and high humidity, thereby measuring the ΔE value and the charge amount, calculating the coefficient of fluctuation of the ambient conditions, and evaluating the blushing. The results obtained are also shown in the following Table 1.

EXAMPLES 2 to 8

The same procedures as described in Example 1 were repeated except that, as shown in the following Table 1, the quantity of rutile type titanium oxide was altered, the photocatalytic component was replaced by anatase-type titanium oxide, by rutile/anatase mixed crystal-type titanium oxide, or by strontium titanate, and the particle diameter of the carrier-covering resin was altered so as to make the charge amount almost the same under the conditions of low temperature and low humidity, thereby performing the measurements and the evaluations in the same manner as in Example 1. The results obtained are also shown in the following Table 1.

For the purpose of making the charge amount uniform under the conditions of low temperature and low humidity, the carrier-covering resin was configured by variously changing the particle diameter of the carrier thereof. Namely, in Table 1, A represents a carrier having a diameter of 65 μm, B represents a carrier having a diameter of 60 μm, C represents a carrier having a diameter of 55 μm, and D represents a carrier having a diameter of 50 μm.

COMPARATIVE EXAMPLES 2 TO 6 AND 8

The same procedures as described in Examples 2 to 6 were repeated except that the irradiation of ultraviolet light was not performed in the process of aging under the conditions of high temperature and high humidity, thereby performing the measurements and the evaluations in the same manner as in Examples 2 to 6. The results obtained are shown also in the following Table 1.

COMPARATIVE EXAMPLE 7

The same procedures as described in Example 1 were repeated except that the photocatalytic component was not employed, thereby performing the measurements and evaluations in the same manner as in Example 1. The results obtained are also shown in the following Table 1.

TABLE 1

| | UV ray under high temperature/ high humidity | Catalytic component | Content of photo-catalytic component (wt %) | Charge amount under low temperature/ low humidity (q/m) | Charge amount under high temperature/ high humidity (q/m) | Coefficient of fluctuation of ambient conditions | Blushing under high temperature/ high humidity ΔE | Carrier-covering resin |
|---|---|---|---|---|---|---|---|---|
| Ex. 1 | Employed | Rutile | 0.1 | 32.4 | 21.9 | 1.48 | 1.3 | A |
| Ex. 2 | Employed | Rutile | 1 | 31.8 | 22.6 | 1.41 | 0.9 | A |
| Ex. 3 | Employed | Rutile | 5 | 31.9 | 24.1 | 1.32 | 0.6 | B |
| Ex. 4 | Employed | Rutile | 10 | 32.3 | 24.4 | 1.32 | 0.6 | C |
| Ex. 7 | Employed | Rutile | 15 | 31.4 | 24.3 | 1.29 | 0.7 | D |
| Comp. Ex. 1 | None | Rutile | 0.1 | 32.4 | 15.4 | 2.10 | 1.7 | A |
| Comp. Ex. 2 | None | Rutile | 1 | 31.8 | 15.2 | 2.09 | 2.1 | A |
| Comp. Ex. 3 | None | Rutile | 5 | 31.9 | 15.0 | 2.01 | 2.6 | B |
| Comp. Ex. 4 | None | Rutile | 10 | 32.3 | 14.8 | 1.95 | 2.8 | C |
| Ex. 5 | Employed | Anatase | 1 | 31.7 | 24.9 | 1.27 | 0.4 | A |
| Comp. | None | Anatase | 1 | 31.7 | 15.3 | 2.07 | 2.1 | A |

TABLE 1-continued

| | UV ray under high temperature/ high humidity | Catalytic component | Content of photo-catalytic component (wt %) | Charge amount under low temperature/ low humidity (q/m) | Charge amount under high temperature/ high humidity (q/m) | Coefficient of fluctuation of ambient conditions | Blushing under high temperature/ high humidity ΔE | Carrier-covering resin |
|---|---|---|---|---|---|---|---|---|
| Ex. 5 | | | | | | | | |
| Ex. 6 | Employed | Rutile/ anatase mixed crystal | 1 | 31.4 | 23.1 | 1.36 | 1.1 | A |
| Comp. Ex. 6 | None | Rutile/ anatase mixed crystal | 1 | 31.4 | 14.9 | 2.11 | 2.5 | A |
| Comp. Ex. 7 | Employed | None | 0 | 33.0 | 15.0 | 2.20 | 2.7 | A |
| Ex. 8 | Employed | $SrTiO_3$ | 1 | 32.0 | 22.5 | 1.42 | 1.22 | A |
| Comp. Ex. 8 | None | $SrTiO_3$ | 1 | 32.0 | 16.2 | 1.98 | 2.5 | A |

In Table 1, "Rutile" represents rutile type titanium oxide; "Anatase" represents anatase-type titanium oxide; and "Rutile/anatase mixed crystal" represents rutile/anatase mixed crystal-type titanium oxide.

It was confirmed, through the comparison between Examples 1 to 6 and Comparative Examples 1 to 6, that the irradiation of ultraviolet light onto the toner comprising titanium oxide was effective in suppressing the deterioration of electrification under the conditions of high temperature and high humidity.

Further, it was also confirmed from Examples 1 to 4 that the aforementioned suppressing effect could be further promoted by increasing the quantity of titanium oxide to be added. However, it was also found from the comparison between Example 4 and Example 7 that when the content of titanium oxide exceeds over 10%, this effect of suppressing the deterioration of electrification under the conditions of high temperature and high humidity was caused to saturate. The reason for this was assumed to be attributed to the fact that when the quantity of titanium oxide was increased, the flocculation of titanium oxide was promoted, thus substantially preventing the increase of the surface area of titanium oxide having photocatalytic effects. In view of this, a preferable content of titanium oxide was found to be within the range of 0.01 to 10% by weight.

The provision of a humidity detector in this invention would be effective in controlling the irradiation amount of ultraviolet light in conformity with humidity, thereby making it possible to further stabilize the charge amount. Further, the image forming apparatus of this invention may be additionally provided with an active oxygen adsorption member such as activated carbon for removing the active oxygen that may be generated due to the irradiation of ultraviolet light.

The developing agent according to this invention can be employed not only in a binary developing agent, but also in other kinds of electrophotographic apparatus wherein a frictional electrification is utilized. It is also possible, without deviating from the scope of this invention, to incorporate various additives such as pigments, wax, lubricant, metal oxides, etc. Further, without deviating from the scope of this invention, the construction of the electrophotographic apparatus can be modified. For example, it can be modified into a non-contact fixing apparatus, a contact electrification apparatus, a cleanerless electrophotographic apparatus, etc.

Additional advantages and modifications will readily occur to those skilled in the art. Therefore, the invention is its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising;

an image carrier; and a developing device for visualizing an electrostatic latent image formed on said image carrier by a developing agent to form a developing agent image, said developing device being disposed to face said image carrier and provided with a member containing a photocatalytic component which is capable of photo-decomposing water molecules to produce active oxygen, and with a light-irradiating mechanism for irradiating light with a wavelength for activating said photocatalytic component.

2. The apparatus according to claim 1, wherein said photocatalytic component is a metal oxide semiconductor.

3. The apparatus according to claim 1, wherein said photocatalytic component is titanium oxide.

4. The apparatus according to claim 3, wherein said titanium oxide is formed of an anatase-type structure.

5. The apparatus according to claim 3, wherein said titanium oxide is formed of primary particles whose diameter is 30 nm or less.

6. The apparatus according to claim 1, wherein said light irradiation mechanism further comprises a mechanism which is capable of altering the irradiation amount.

7. The apparatus according to claim 1, wherein said light irradiation mechanism is disposed on a developing roller.

8. The apparatus according to claim 1, wherein said developing device is provided with an envelope, part of which is constituted by a light transmitting member.

9. The apparatus according to claim 1, wherein said light irradiation mechanism comprises a light source, and a lens or mirror for guiding light.

10. The apparatus according to claim 1, wherein said light irradiation mechanism is disposed at a portion of the wall of the developing device.

11. The apparatus according to claim 1, wherein said developing device is further provided therein with an active oxygen-adsorbing member.

12. A developing agent which comprises a binder resin, a coloring agent, and a photocatalytic component which is capable of photo-decomposing water molecule to thereby produce active oxygen.

13. The developing agent according to claim 12, wherein said photocatalytic component is a metal oxide semiconductor.

14. The developing agent according to claim 12, wherein said photocatalytic component is titanium oxide.

15. The developing agent according to claim 14, wherein said titanium oxide is formed of an anatase-type structure.

16. The developing agent according to claim 14, wherein said titanium oxide is formed of primary particles whose diameter is 30 nm or less.

* * * * *